US007699161B2

(12) United States Patent
Tokarski et al.

(10) Patent No.: US 7,699,161 B2
(45) Date of Patent: Apr. 20, 2010

(54) OPHTHALMIC LENS PACKAGE WITH INTERNAL DRAINAGE MEMBER

(75) Inventors: Michael Tokarski, Ponte Vedra, FL (US); James Peck, Jacksonville, FL (US); Edward Dzwill, Flemington, NJ (US); George Brock, St. Augustine, FL (US); Roger W. Smith, Grove City, OH (US); Michael Scott Ulrich, Columbus, OH (US); Raymond J. Sander, Mt. Vernon, OH (US)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 298 days.

(21) Appl. No.: 11/086,016

(22) Filed: Mar. 22, 2005
(Under 37 CFR 1.47)

(65) Prior Publication Data

US 2006/0213784 A1 Sep. 28, 2006

(51) Int. Cl.
*A45C 11/04* (2006.01)

(52) U.S. Cl. ..... 206/5.1

(58) Field of Classification Search ..... 206/5.1, 206/363, 205, 210; 134/901; 422/301
See application file for complete search history.

(56) References Cited

U.S. PATENT DOCUMENTS

| | | | | | |
|---|---|---|---|---|---|
| 2,944,661 | A * | 7/1960 | Goldstein | 206/5.1 |
| 3,072,132 | A | 1/1963 | Middleton | |
| 3,621,855 | A | 11/1971 | Rabinowitz | |
| 4,444,307 | A * | 4/1984 | Jermyn | 206/5.1 |
| 4,691,820 | A * | 9/1987 | Martinez | 206/5.1 |
| 4,721,124 | A * | 1/1988 | Tuerkheimer et al. | 134/901 |
| 5,409,104 | A | 4/1995 | Lovell | |
| 5,431,879 | A * | 7/1995 | Heyl et al. | 134/901 |
| 5,993,755 | A * | 11/1999 | Andersen | 422/300 |
| 6,029,808 | A | 2/2000 | Peck et al. | |
| 6,286,666 | B1 * | 9/2001 | Umdasch | 206/5.1 |
| 6,868,963 | B2 * | 3/2005 | Borovsky | 206/5.1 |
| 2004/0140229 | A1 | 7/2004 | Borovsky | |
| 2007/0000792 | A1 * | 1/2007 | Newman et al. | 206/5.1 |

* cited by examiner

*Primary Examiner*—Luan K Bui

(57) ABSTRACT

An ophthalmic lens package comprises a shell having an internal cavity accessible through an opening in the shell and a drainage member that divides the internal chamber into an upper chamber and a lower chamber. The drainage member is permeable to aqueous liquids and is arranged to allow drainage of liquid from the upper chamber to the lower chamber. This arrangement of the ophthalmic lens package allows the consumer to retrieve the lens from the upper chamber without handling any significant amount of saline solution.

9 Claims, 5 Drawing Sheets

OPHTHALMIC LENS PACKAGE WITH INTERNAL DRAINAGE MEMBER

FIELD OF INVENTION

The present invention relates to packages for the storage and shipping of ophthalmic lenses, particularly soft contact lenses. More particularly, the present invention relates to packages having an internal drainage system that allows separation of the ophthalmic lens from the solution when the lens is removed from the package.

BACKGROUND OF THE INVENTION

Soft contact lenses have become increasingly popular since they were first introduced in the 1970's. Due to progressive reductions in manufacturing costs, soft contact lenses are now an attractive and economical choice for the consuming public. Such lenses may be frequently replaced by the consumers (e.g., on a daily or weekly basis) and do not need to be cleaned or sterilized as often as traditional contact lenses. Of course, the consumer desires to keep a supply of lenses on hand that is commensurate with the frequency with which the lenses are replaced. Therefore, consumer demand for disposable soft contact lenses has led to a need for disposable packages that are easy to use and inexpensive. The packages should be constructed to provide safe storage and shipping for the lenses. It is also desirable that the individual packages be as small as possible, so that they may be easily and unobtrusively stored and carried.

Soft contact lenses are often packaged and stored in a hydrated state, which requires that they be sealed in packages with a storage solution. One widely-used package is the "blister pack", which, in general, comprises a rigid plastic container having a flat upper surface with a concave-shaped well that contains a single ophthalmic lens with a quantity of solution. The well is covered with a flexible cover that is sealed along the perimeter of the upper surface. The blister packs are boxed for shipping and storage until a lens is needed by a consumer. The consumer then peels back the flexible cover from the blister pack to expose the ophthalmic lens. The consumer then pours the lens out into his or her hand, together with the saline solution, and places the lens on the tip of his or her finger for application to the eye.

A need remains for ophthalmic lens packaging systems that include a solution for storage and shipping of the ophthalmic lenses, but allow the solution to be separated from the lens at the time that the lens is removed from the package.

BRIEF DESCRIPTION OF THE DRAWINGS

For a more complete understanding of the present invention, reference is made to the following detailed description of the present invention considered in conjunction with the accompanying drawings, in which.

DETAILED DESCRIPTION OF THE INVENTION

Figure 1:
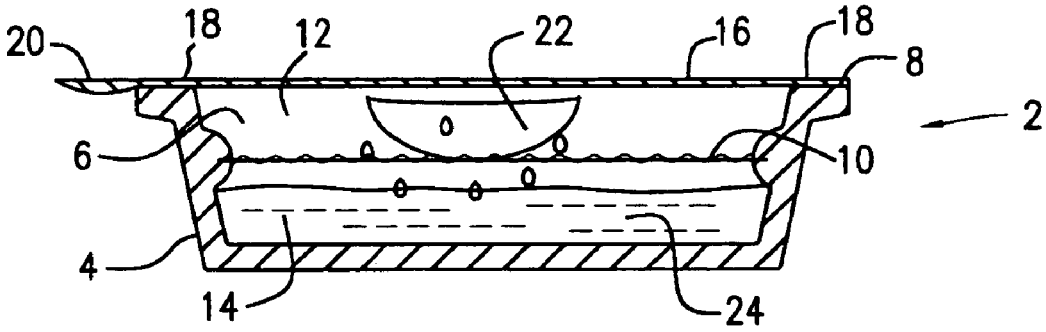
FIG. 1 is a cross-sectional view of an embodiment of a ophthalmic lens package according to the present invention in which the ophthalmic lens package is sealed for shipping and storage.
Figure 2:
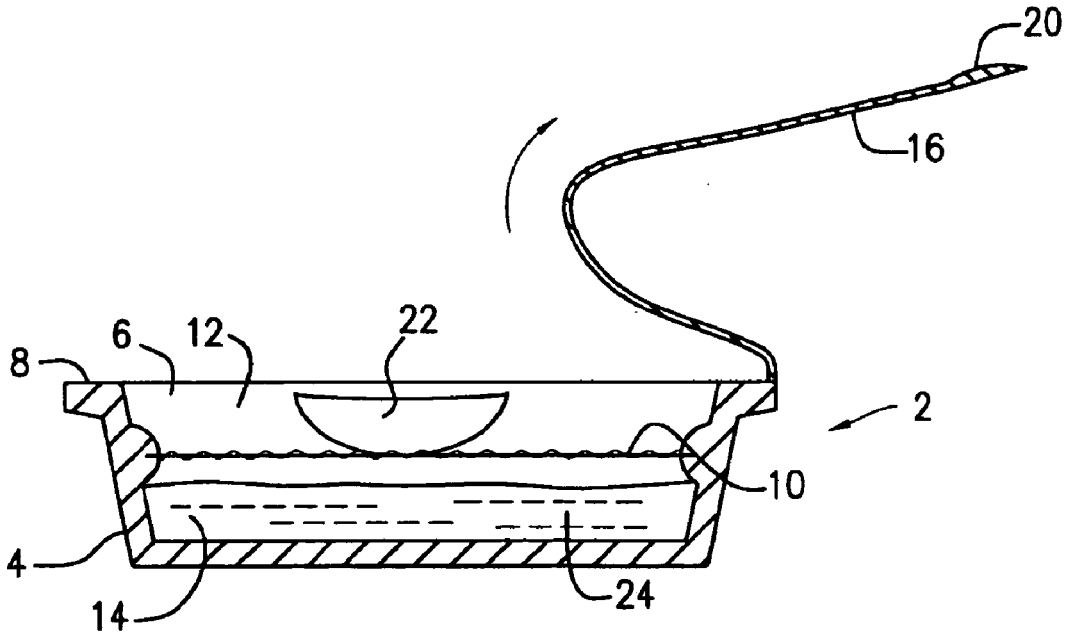
FIG. 2 is a cross-sectional view of the ophthalmic lens package of FIG. 1 in which the ophthalmic lens package has been opened to provide access to a contact lens.
Figure 3:
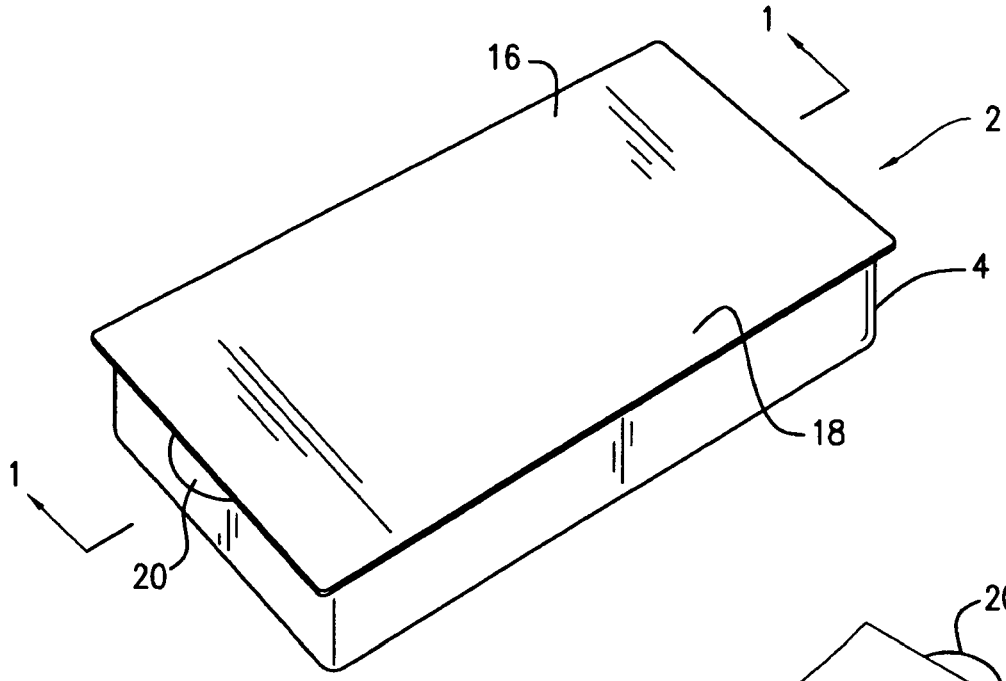
FIG. 3 is a perspective view of the sealed ophthalmic lens package of FIG. 1.
Figure 4:
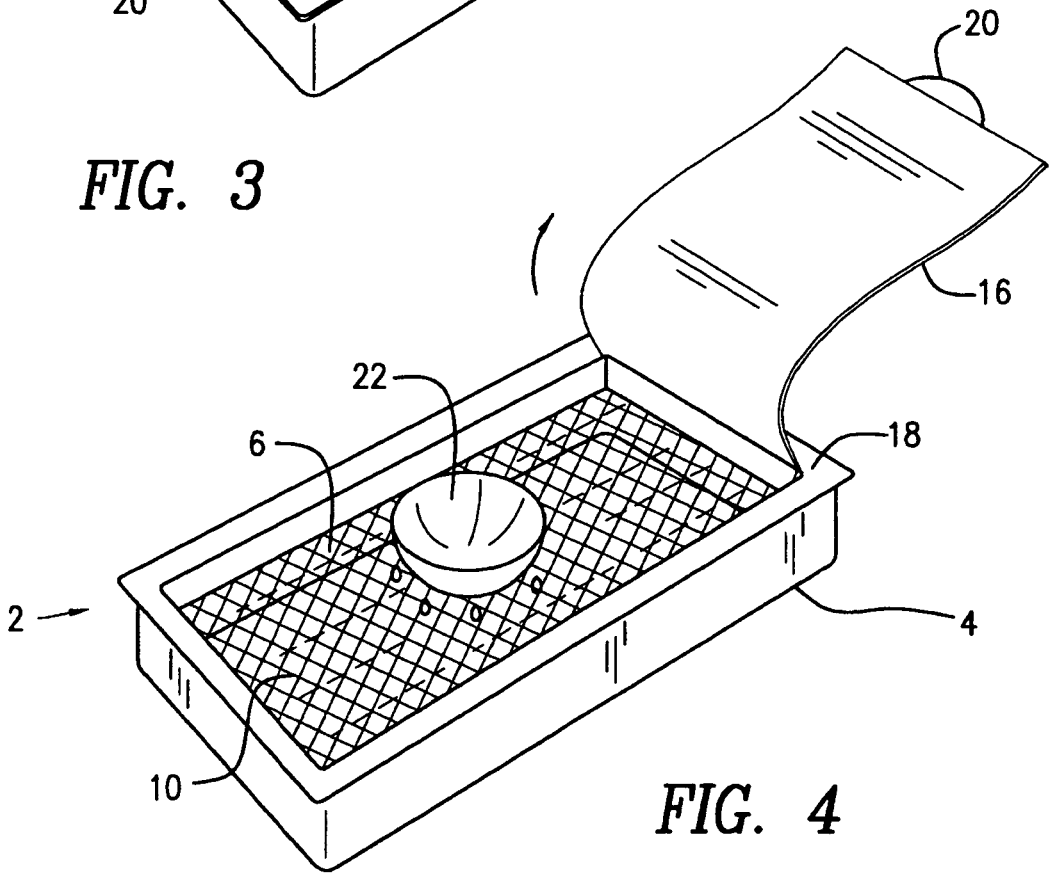
FIG. 4 is a perspective view of the opened ophthalmic lens package of FIG. 1.

An ophthalmic lens package, comprising:

a shell defining an opening and having an internal cavity accessible through said opening; and dividing means for dividing said cavity into an upper chamber and a lower chamber, said upper chamber having an interior accessible through said opening, said dividing means allowing the permeation of aqueous liquid between said upper chamber and said lower chamber.

As used herein the term "ophthalmic lens" refers to a device that resides on an eye, including, but not limited to, hard contact lenses, soft contact lenses, intra-ocular lenses and overlay lenses and preferably soft contact lenses. A first preferred embodiment of an ophthalmic lens package 2 according to the present invention is shown in FIGS. 1-4. Referring to FIGS. 1-4, an ophthalmic lens package 2 has a shell 4 with an interior cavity 6 and an upwardly-facing perimeter rim 8. A drainage member 10, such as a mesh or a perforated plastic sheet, is secured to the shell 4 so as to divide the interior cavity 6 into an upper chamber 12 and a lower chamber 14. A sealing cover 16, such as a foil member, is used to seal the interior cavity 6 of the shell 4. A perimeter portion 18 of the sealing cover 16 is secured to the upwardly-facing perimeter rim 8 of the shell 4 so as to form a continuous liquid-tight seal along the entire upwardly-facing perimeter rim 8. The sealing cover 16 is provided with a tab 20 that extends beyond the perimeter portion 18 of the sealing cover 16 so that the tab 20 may be used as a handle for separating the sealing cover 16 from the shell 4. The consumer gains access to ophthalmic lens 22 by grasping the tab 20 and pulling it upward and across the upwardly-facing rim 8 of the shell 4, thereby separating the sealing cover 16 from the shell 4 and exposing ophthalmic lens 22 for retrieval by the consumer (see FIGS. 2 and 4).

The drainage member 10 is arranged within the interior cavity 6 so that ophthalmic lens 22 may rest in an inverted position on the drainage member 10, within the upper chamber 12, without contacting the sealing cover 16 that is sealed to the shell 4. When ophthalmic lens package 2 is prepared for shipping or storage of ophthalmic lens 22, a volume of saline solution 24 is included within the interior cavity 6 of the shell 4. The volume of saline solution 24 is less than the volume of the lower chamber 16 so that the entire volume of saline solution 24 may be contained within the lower chamber 16 when ophthalmic lens package 2 is stored in a horizontal position (see, e.g., FIGS. 1 and 2).

When ophthalmic lens container 2 is shipped or stored in a horizontal position, substantially all of the saline solution 24 remains in the lower chamber 14. Water vapor from the saline solution 24 permeates into the upper chamber 12 through the drainage member 10, so that ophthalmic lens 22 remains hydrated in the water vapor-saturated atmosphere in the upper chamber 12. In the event that a portion of the saline solution 24 enters the upper chamber 12, the saline solution 24 will drain back through the drainage member 10 into the lower chamber 14 when ophthalmic lens package 2 is returned to a horizontal position (see, e.g., FIGS. 1 and 2). Such drainage allows the consumer to remove the lens without inserting his or her finger into standing saline solution. Preferably the drainage leaves ophthalmic lens 22 substantially free of the saline solution 24 when the consumer retrieves ophthalmic lens 22. Therefore, it is preferable that the drainage member 10 be arranged to allow rapid and complete drainage of the saline solution 24 from the upper chamber 12. The drainage member 10, therefore, is preferably an open mesh, although, as an alternative, a perforated member of a hydrophobic plastic material may be used.

Figure 5:
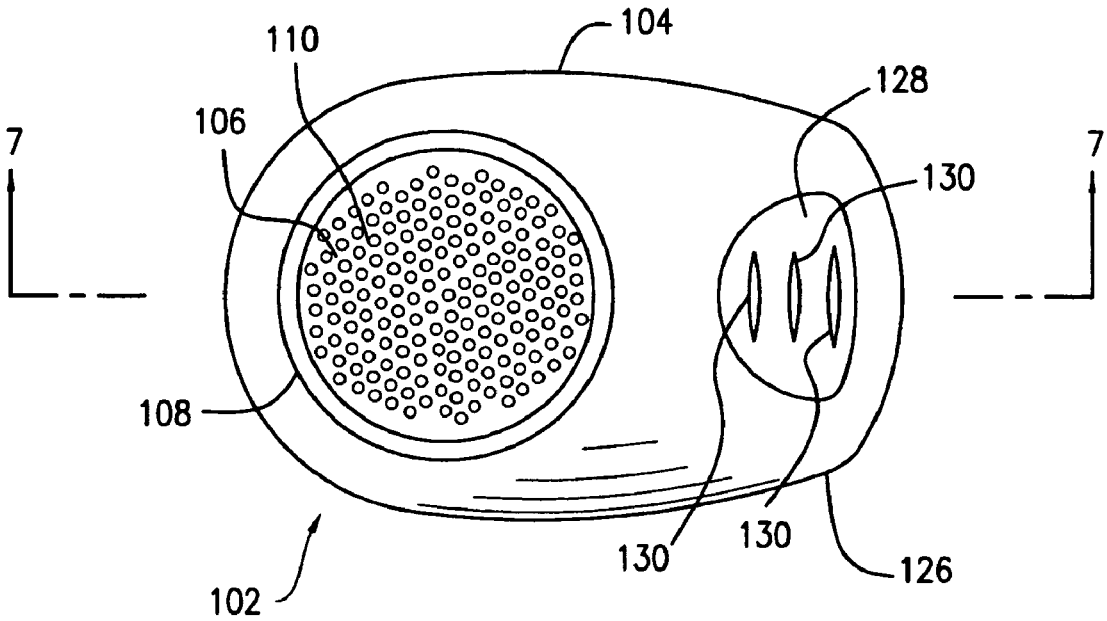
FIG. 5 is a top view of the shell of another embodiment of a ophthalmic lens package according to the present invention.
Figure 6:
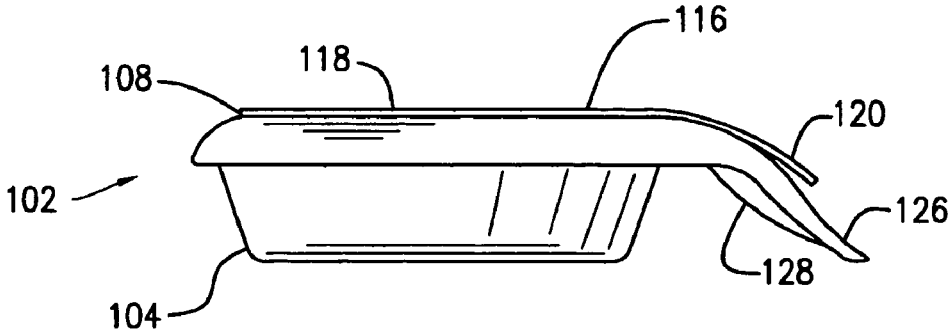
FIG. 6 is a side view of the ophthalmic lens package of FIG. 5 in which the ophthalmic lens package has been sealed for shipping and storage.
Figure 7:
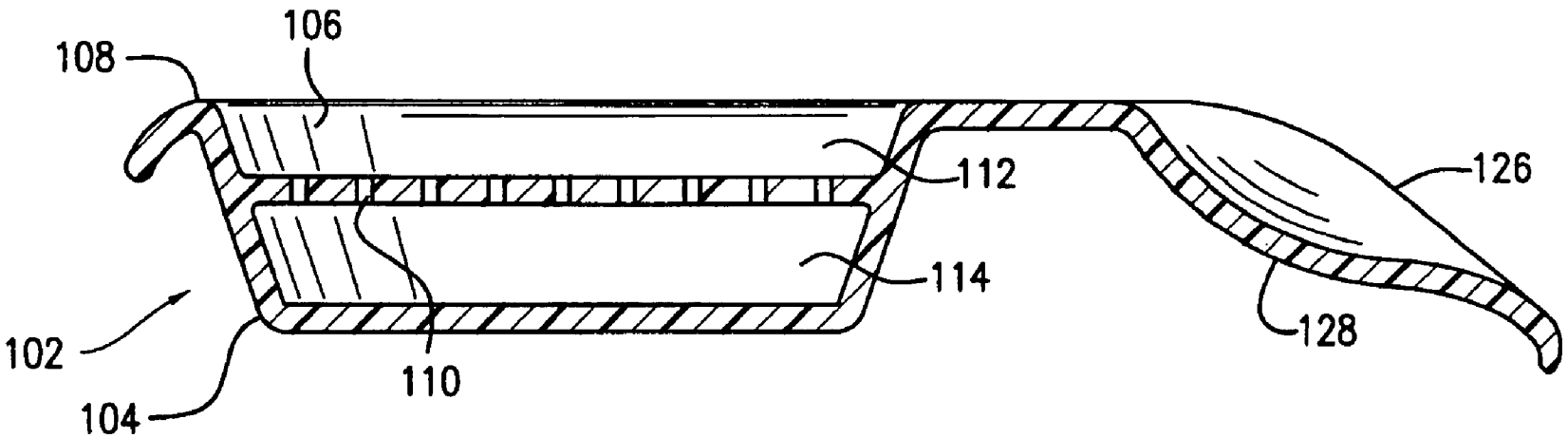
FIG. 7 is a cross-sectional view of the shell of FIG. 5.

A second preferred embodiment of an ophthalmic lens package 2 according to the present invention is presented in FIGS. 5-7. Reference numbers for features that the second embodiment has in common with the first embodiment are the same as those reference numbers used in the description of the first embodiment, incremented by one hundred (100).

Referring to FIGS. 5-7, an ophthalmic lens package 102 has a shell 104 with an interior cavity 106 and an upwardly-facing perimeter rim 108. A drainage member 110, which is, in this second embodiment, a perforated member of a hydrophobic plastic, is molded into the shell 104 and arranged so as to divide the interior cavity 106 into an upper chamber 112 and a lower chamber 114. A sealing cover 116, such as a foil member (see FIG. 6), is used to seal the interior cavity 106 of the shell 104. A perimeter portion 118 of the sealing cover 116 is secured to the upwardly-facing perimeter rim 108 of the shell 104 so as to form a continuous liquid-tight seal along the entire upwardly-facing perimeter rim 108. The sealing cover 116 is provided with a tab 120 that extends beyond the perimeter rim 108 so that the tab 120 may be used as a handle for separating the sealing cover 116 from the shell 104. The drainage member 110 is arranged within the interior cavity 106 so that a soft contact lens (not shown) may rest in an inverted position on the drainage member 110, within the upper chamber 112, without contacting the sealing cover 116 that is sealed to the shell 104. When ophthalmic lens package 102 is prepared for shipping or storage of the ophthalmic lens, a volume of saline solution (not shown) is included within the interior cavity 106 of the shell 104. The volume of saline solution is less than the volume of the lower chamber 114 so that the entire volume of saline solution may be contained within the lower chamber 114 when ophthalmic lens package 102 is stored in a horizontal position. Ophthalmic lens package 102 is further provided with a handle portion 126 which extends from the shell 104 in a direction away from the interior cavity 106. The handle portion 126 may be provided with a gripping surface, such as a thumb depression 128 with ridges 130.

The consumer gains access to the ophthalmic lens in a similar manner to that described for the first embodiment (i.e., ophthalmic lens package 2). The consumer grasps the handle portion 126 between the fingers of one hand and the tab 120 between the fingers of the other hand. The consumer then pulls the tab 120 upward and across the upwardly-facing rim 108 of the shell 104, thereby separating the sealing cover 116 from the shell 104 and exposing the ophthalmic lens for retrieval by the consumer.

As with the first embodiment, the ophthalmic lens in the second embodiment (i.e., ophthalmic lens package 102) remains hydrated during shipping and storage in the water vapor-saturated atmosphere in the upper chamber 112 from water vapor that has permeated from saline solution in the lower chamber 114. Any portion of the saline solution that enters the upper chamber 112 drains through the drainage member 110 into the lower chamber 114 when ophthalmic lens package 102 is returned to a horizontal position, leaving the ophthalmic lens free of the saline solution.

The shell of the invention can be fabricated from a number of know materials, such as polypropylene, polyethylene, and the like. Ophthalmic lens packages 2, 102 of the present invention can be fabricated to have an interior cavity with dimensions of about 2-3 cm by about 2-3 cm and a depth of about 0.5 cm, with its minimum dimensions limited only by the size of the ophthalmic lens to be stored and the volume of saline solution (or other ophthalmic solutions containing ocular medicaments, wetting agents, antimicrobial agents and the like) to be provided. Preferably, the amount of solution is between about 900 μL and about 1,500 μL, more preferably between about 900 μL and about 1,000 μL. The resulting small overall size of the ophthalmic lens package allows it to be easily and unobtrusively carried. The cover for the shell may be made from foil/polymer laminate or coextrusion, made of a metal layer, such as aluminum and one or more polymer layers, such as polypropylene, coating the metal layer. The cover materials may include any flexible material that acts as a barrier to air borne contaminants and may be hermetically sealed to the shell.

Figure 8:
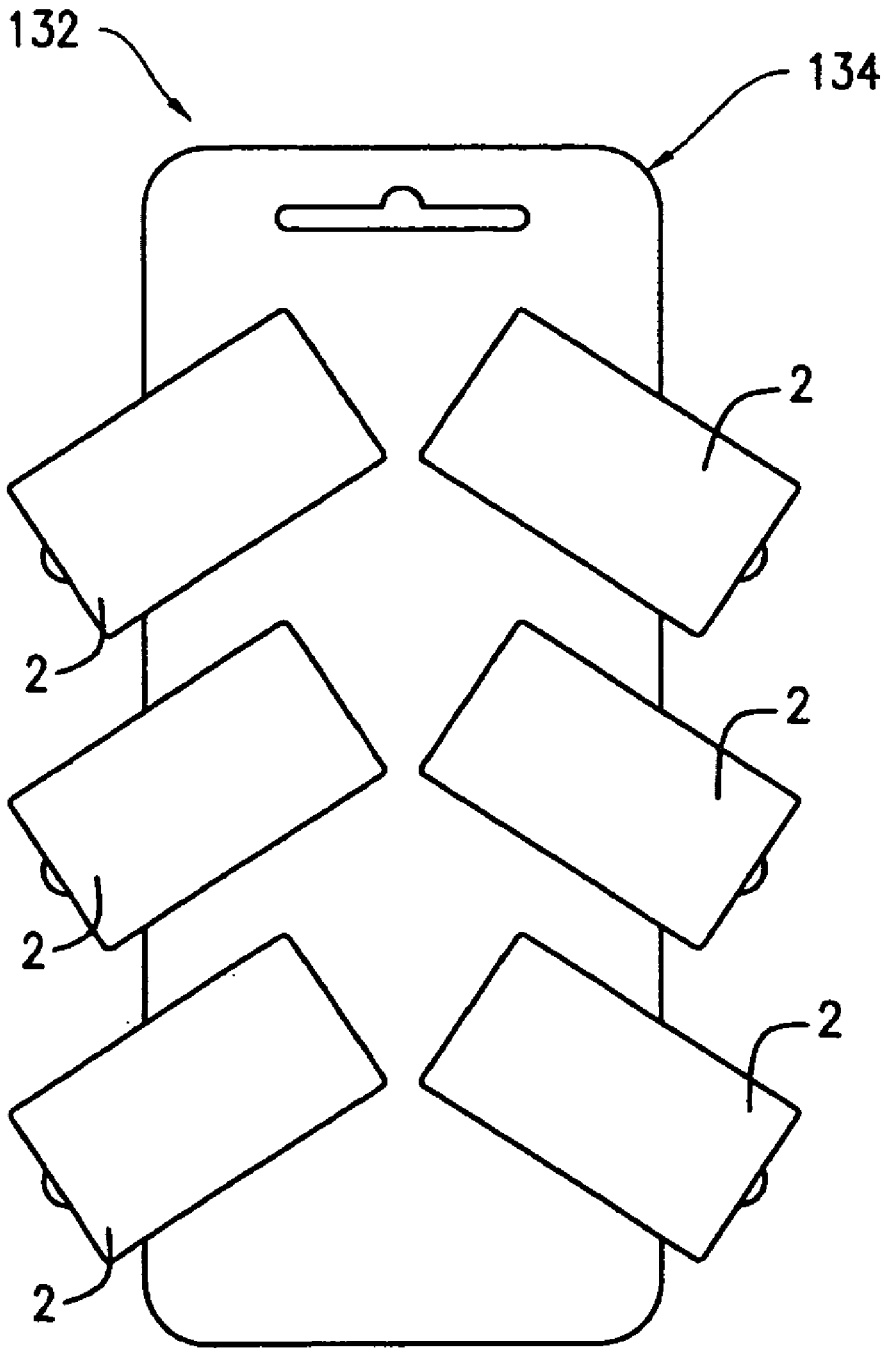
FIG. 8 is a frontal view of a plurality of ophthalmic lens packages according to the present invention assembled for display and storage.

A number of ophthalmic lens packages may also be conveniently stored. For example, FIG. 8 illustrates a storage and display arrangement 132 where six ophthalmic lens packages 2 are mounted on a pegboard card 134 with an overall size of about 12 cm by 18 cm.

It will be understood that the embodiments described herein are merely exemplary and that a person skilled in the art may make many variations and modifications without departing from the spirit and scope of the present invention. For instance, structures other than a film or foil may be used to seal the interior cavity of the ophthalmic lens package. Examples of such structures include plugs or screw-top fittings. The shell of the ophthalmic lens case may have handle portions that are configured differently than the handle portion illustrated in the second embodiment and may have more than one handle portion. All such variations and modifications, including those discussed within the detailed description, are intended to be included within the scope of the present invention.

We claim:

1. An ophthalmic lens package, comprising:

a shell defining an opening and having an internal cavity accessible through said opening;

dividing means secured to said shell for dividing said cavity into an upper chamber and a lower chamber, said upper chamber having an interior accessible through said opening, said dividing means allowing the permeation of aqueous liquid between said upper chamber and said lower chamber, covering means comprising a foil/polymer laminate or coextrusion for covering said opening and forming a liquid-tight hermetic seal with said shell;

an opthalmic lens contained entirely within said upper chamber; and a quantity of an aqueous solution contained within said cavity, said lower chamber having a volume sufficiently large to contain the entire quantity of said aqueous solution.

2. The package of claim 1, wherein said dividing means is arranged to allow drainage of aqueous liquid from said upper chamber into said lower chamber.

3. The package of claim 2, wherein said dividing means comprises a mesh.

4. The package of claim 2, wherein said dividing means comprises a plastic member having perforations therethrough.

5. The package of claim 1, wherein said covering means has an edge with a grippable tab.

6. The package of claim 1, wherein said interior of said upper chamber is sized and shaped to contain an ophthalmic lens entirely within said upper chamber and said lower chamber has an interior that is sized to contain an aqueous liquid.

7. The package of claim 1, further comprising a grippable handle.

8. The package of claim 1, wherein said shell includes a rim which defines said opening, wherein said covering means a liquid-tight hermetic seal with said rim.

9. The package of claim 8, wherein said covering means includes an edge with a grippable tab.

* * * * *